US008777646B2

(12) United States Patent
Doubt

(10) Patent No.: US 8,777,646 B2
(45) Date of Patent: Jul. 15, 2014

(54) ELECTRICAL SOCKET ADAPTOR

(76) Inventor: Ruxton C. Doubt, Seattle, WA (US)

( * ) Notice: Subject to any disclaimer, the term of this patent is extended or adjusted under 35 U.S.C. 154(b) by 0 days.

(21) Appl. No.: 13/458,563

(22) Filed: Apr. 27, 2012

(65) Prior Publication Data

US 2012/0276771 A1 Nov. 1, 2012

Related U.S. Application Data

(60) Provisional application No. 61/480,998, filed on Apr. 29, 2011.

(51) Int. Cl.
*H01R 13/15* (2006.01)

(52) U.S. Cl.
USPC ..... 439/265

(58) Field of Classification Search
USPC ..... 439/265, 268–270, 825–829
See application file for complete search history.

(56) References Cited

U.S. PATENT DOCUMENTS

| | | | | | |
|---|---|---|---|---|---|
| 1,495,153 | A | * | 5/1924 | Benjamin | 439/692 |
| 1,802,230 | A | * | 4/1931 | Aletter | 439/673 |
| 2,037,562 | A | * | 4/1936 | Chirelstein | 439/692 |
| 2,121,338 | A | * | 6/1938 | Chirelstein | 439/692 |
| 2,131,856 | A | * | 10/1938 | Lambert | 439/692 |
| 2,159,938 | A | * | 5/1939 | Chirelstein | 439/692 |
| 2,159,939 | A | * | 5/1939 | Chirelstein | 439/825 |
| 2,183,016 | A | * | 12/1939 | Gilbert | 439/747 |
| 2,183,067 | A | * | 12/1939 | Gardner | 439/825 |
| 2,191,297 | A | * | 2/1940 | Olson | 439/825 |
| 2,203,122 | A | * | 6/1940 | Anderson | 439/825 |
| 2,260,509 | A | * | 10/1941 | Chirelstein | 439/825 |
| 2,261,615 | A | * | 11/1941 | Cornwell | 439/265 |
| 2,294,608 | A | * | 9/1942 | Rudolphsen | 439/599 |
| 2,337,735 | A | * | 12/1943 | Brus | 439/598 |
| 2,398,684 | A | * | 4/1946 | Woodward | 439/827 |
| 2,401,430 | A | * | 6/1946 | Lake | 439/746 |
| 2,434,154 | A | * | 1/1948 | Gurin | 439/695 |
| 2,439,767 | A | * | 4/1948 | Wermine | 439/825 |
| 2,443,797 | A | * | 6/1948 | Miller | 439/651 |
| 2,474,454 | A | * | 6/1949 | Avery | 439/259 |
| 2,522,341 | A | * | 9/1950 | Brus | 439/695 |
| 2,542,609 | A | * | 2/1951 | Wyglendowski | 439/694 |
| 2,594,850 | A | * | 4/1952 | Benander | 439/694 |
| 2,640,184 | A | * | 5/1953 | Bauer | 439/655 |
| 2,690,546 | A | * | 9/1954 | Ostrak | 439/827 |
| 2,709,247 | A | * | 5/1955 | Alden | 439/731 |
| 2,759,163 | A | * | 8/1956 | Ustin et al. | 439/866 |
| 2,866,172 | A | * | 12/1958 | Sapper et al. | 439/825 |
| 2,982,938 | A | * | 5/1961 | Klumpp, Jr. | 439/423 |
| 3,044,035 | A | * | 7/1962 | Adams, Jr. | 439/115 |
| 3,086,191 | A | * | 4/1963 | Olashaw | 439/694 |
| 3,093,434 | A | * | 6/1963 | Francis | 439/695 |
| 3,123,427 | A | * | 3/1964 | Yopp | 439/825 |
| 3,178,676 | A | * | 4/1965 | Antes | 439/827 |
| 3,204,212 | A | * | 8/1965 | Kennedy | 439/598 |

(Continued)

*Primary Examiner* — Ross Gushi
(74) *Attorney, Agent, or Firm* — Seed IP Law Group PLLC

(57) ABSTRACT

An adaptor device for electrical sockets is provided that includes a body having an interior; a pair of prongs extending from the body in spaced parallel relationship; a pair of receptacles extending into the interior of the body, each receptacle structured to be in electrical contact with a respective prong of the pair of prongs; and a pair of prong springs received over the pair of prongs, each prong spring having a pair of flexible side walls that are structured to bulge outward away from the prong.

4 Claims, 15 Drawing Sheets

(56) References Cited

U.S. PATENT DOCUMENTS

| | | | | | |
|---|---|---|---|---|---|
| 3,204,213 | A | * | 8/1965 | Bauer | 439/171 |
| 3,218,599 | A | * | 11/1965 | Winkler | 439/295 |
| 3,358,265 | A | * | 12/1967 | Robards | 439/697 |
| 3,368,187 | A | * | 2/1968 | Faul et al. | 439/750 |
| 3,375,486 | A | * | 3/1968 | Clayton | 439/827 |
| 3,397,383 | A | * | 8/1968 | Prifogle et al. | 439/825 |
| 3,543,218 | A | * | 11/1970 | Archer | 439/346 |
| 3,609,630 | A | * | 9/1971 | Francis | 439/106 |
| 3,614,715 | A | * | 10/1971 | Marx | 439/825 |
| 3,668,779 | A | * | 6/1972 | Turner | 29/858 |
| 3,691,327 | A | * | 9/1972 | Chesler | 200/43.02 |
| 3,777,285 | A | | 12/1973 | Barr | |
| 3,786,558 | A | | 1/1974 | McCarthy | |
| 3,858,956 | A | * | 1/1975 | Garrett | 439/106 |
| 3,909,099 | A | * | 9/1975 | Winkler | 439/295 |
| 3,958,849 | A | | 5/1976 | Blairsdale | |
| 4,018,497 | A | * | 4/1977 | Bulanchuk | 439/115 |
| 4,083,617 | A | * | 4/1978 | Wyatt | 439/295 |
| 4,111,509 | A | * | 9/1978 | Novak | 439/102 |
| 4,136,919 | A | * | 1/1979 | Howard et al. | 439/346 |
| 4,305,634 | A | * | 12/1981 | Lewis | 439/892 |
| 4,422,711 | A | * | 12/1983 | Wolowicz | 439/827 |
| 4,566,187 | A | * | 1/1986 | Chen | 29/857 |
| 4,596,440 | A | * | 6/1986 | Quam | 439/827 |
| 4,867,697 | A | * | 9/1989 | Borges | 439/265 |
| 5,007,857 | A | * | 4/1991 | Wright | 439/490 |
| 5,051,097 | A | | 9/1991 | Miles et al. | |
| 5,082,450 | A | * | 1/1992 | Warren et al. | 439/102 |
| 5,108,301 | A | * | 4/1992 | Torok | 439/263 |
| 5,194,013 | A | * | 3/1993 | Propp | 439/265 |
| 5,197,897 | A | * | 3/1993 | Torok | 439/263 |
| 5,207,603 | A | * | 5/1993 | Peloza | 439/884 |
| 5,249,976 | A | * | 10/1993 | Brock | 439/102 |
| 5,320,560 | A | * | 6/1994 | Fladung | 439/490 |
| 5,338,218 | A | | 8/1994 | Haas | |
| 5,470,252 | A | * | 11/1995 | Fladung | 439/490 |
| 5,480,318 | A | * | 1/1996 | Garrison | 439/346 |
| 5,533,915 | A | * | 7/1996 | Deans | 439/678 |
| 5,554,049 | A | * | 9/1996 | Reynolds | 439/490 |
| 5,556,308 | A | * | 9/1996 | Brown et al. | 439/746 |
| 5,730,631 | A | * | 3/1998 | Tsang | 439/881 |
| 5,863,364 | A | * | 1/1999 | Lin et al. | 156/73.1 |
| 5,947,755 | A | | 9/1999 | Conway | |
| 6,050,837 | A | * | 4/2000 | Duhe, Jr. | 439/270 |
| 6,099,338 | A | * | 8/2000 | Huang | 439/350 |
| 6,171,129 | B1 | * | 1/2001 | Phillips | 439/346 |
| 6,290,533 | B1 | * | 9/2001 | Major | 439/490 |
| 6,428,339 | B1 | * | 8/2002 | Davidson et al. | 439/346 |
| 6,461,176 | B1 | * | 10/2002 | Haas | 439/133 |
| 6,619,975 | B2 | * | 9/2003 | Bentley et al. | 439/346 |
| 6,676,428 | B2 | * | 1/2004 | Burton | 439/270 |
| 6,875,040 | B1 | * | 4/2005 | O'Keefe et al. | 439/346 |
| 6,896,537 | B2 | * | 5/2005 | Burton | 439/346 |
| 6,948,963 | B2 | * | 9/2005 | Burton | 439/246 |
| 7,004,595 | B1 | * | 2/2006 | Stoddard | 362/95 |
| 7,052,303 | B2 | * | 5/2006 | Burton | 439/346 |
| 7,121,707 | B2 | * | 10/2006 | Currie et al. | 362/555 |
| 7,140,902 | B2 | * | 11/2006 | Burton | 439/347 |
| 7,175,463 | B2 | * | 2/2007 | Burton | 439/346 |
| 7,182,615 | B1 | * | 2/2007 | Liu | 439/263 |
| 7,374,460 | B1 | * | 5/2008 | Hariharesan et al. | 439/679 |
| 7,377,823 | B2 | | 5/2008 | Chen | |
| 7,530,855 | B2 | * | 5/2009 | Hariharesan et al. | 439/679 |
| 7,798,838 | B2 | * | 9/2010 | Grieff et al. | 439/346 |
| 7,867,038 | B2 | * | 1/2011 | Hariharesan et al. | 439/679 |
| 8,105,106 | B1 | * | 1/2012 | Stoddard | 439/490 |
| 8,317,551 | B2 | * | 11/2012 | Aboulkassem et al. | 439/825 |
| 2004/0147157 | A1 | * | 7/2004 | Burton | 439/346 |
| 2005/0124209 | A1 | * | 6/2005 | Currie et al. | 439/490 |
| 2005/0186828 | A1 | * | 8/2005 | Burton | 439/346 |
| 2005/0255738 | A1 | * | 11/2005 | Burton | 439/369 |
| 2006/0205261 | A1 | * | 9/2006 | Burton | 439/346 |
| 2009/0061667 | A1 | | 3/2009 | Grieff | |

* cited by examiner

ELECTRICAL SOCKET ADAPTOR

BACKGROUND OF THE INVENTION

1. Technical Field

The present disclosure is directed to a device for adapting a failed electrical socket to establish electrical contact with an external plug and, more particularly, to an adaptor having expandable prongs configured to contact existing plates in an electrical socket and accompanying circuitry to provide visual indication of electrical contact.

2. Description of the Related Art

Electrical wall receptacles can become worn and unusable due to wearing of the internal contact plates. More particularly, these plates suffer from what is known in the electrical industry as "relaxation" in which the metal plates inside the receptacle no longer grab or hold the prongs of an external plug with sufficient tension to retain the prongs in electrical contact with the plates. As such, the flow of electricity will become interrupted, either intermittently or permanently.

SUMMARY OF THE INVENTION

The present disclosure is directed to an adaptor device for electrical sockets, the device including a body having an interior; a pair of prongs extending from the body in spaced parallel relationship; a pair of receptacles extending into the interior of the body, each receptacle structured to be in electrical contact with a respective prong of the pair of prongs; and a pair of prong springs received over the pair of prongs, each prong spring having a pair of flexible side walls that are structured to bulge outward away from the prong.

In accordance with another aspect of the present disclosure, the device is structured such that each prong extending from the body has a distal end with opposing corners, each corner having a cut-out portion, and wherein each spring has a distal terminal tip connected to each side wall, the terminal tip having opposing lateral corners that are crimped to fit within the cut-out portion of a prong on which the prong spring is mounted to prevent lateral movement of the prong spring relative to the prong.

In accordance with a further aspect of the present disclosure, each side wall of the prong springs has a proximal end, and each side wall has a leg extending from the proximal end of the side wall. Each leg is configured to cooperate with the body to retain the prong spring on the respective prong.

In accordance with still yet another aspect of the present disclosure, the device further includes an automatic reset thermostat coupled to the pair of prongs in the interior of the body that is configured to electrically uncouple the pair of prongs from the pair of receptacles when the automatic reset thermostat senses a temperature condition.

In accordance with still yet another aspect of the present disclosure, the device further includes a visual indicator electrically coupled to the pair of prongs and configured to provide a visual indication of electrical continuity between the prongs.

In accordance with a further aspect of the present disclosure, the foregoing features may be combined individually or in various subcombinations to provide enhanced performance of the adaptor.

In accordance with another aspect of the present disclosure, an a device is provided that includes a body having an external wall and an interior; a pair of prongs extending outward from the interior of the body in spaced parallel relationship; a pair of receptacles extending into the interior of the body and electrically coupled to the pair of prongs; and a pair of prong springs, each prong spring received over a respective prong of the pair of prongs, each prong spring having a pair of flexible side walls that are structured to bulge outward away from the prong.

BRIEF DESCRIPTION OF THE SEVERAL VIEWS OF THE DRAWINGS

The foregoing and other features of the present invention will be more readily appreciated as the same become better understood from the following detailed description when taken in conjunction with the accompanying drawings wherein.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment.

Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the embodiments.

One embodiment of the present disclosure is directed to a Locking Socket Adapter (LSA) 20 structured to provide electrical contact between a plug and an outlet that is performing poorly. Due to years of use, the metal plates inside an outlet become separated. Because these plates serve as electrical contacts, the separation of the metal plates may interrupt the flow of electricity from the outlet to the prongs on the external plug.

The LSA 20 is structured to provide additional holding power between the outlet and the plug. Because the metal plates are separated within the outlet, they can no longer tightly hold the plug in the outlet. The LSA solves this problem through an adaptor that provides increased holding power.

All dimensions of prongs, LSA openings, housings, etc. are compliant with ANSI standards, as are all materials used in construction of the LSA 20 disclosed herein.

Figure 1:
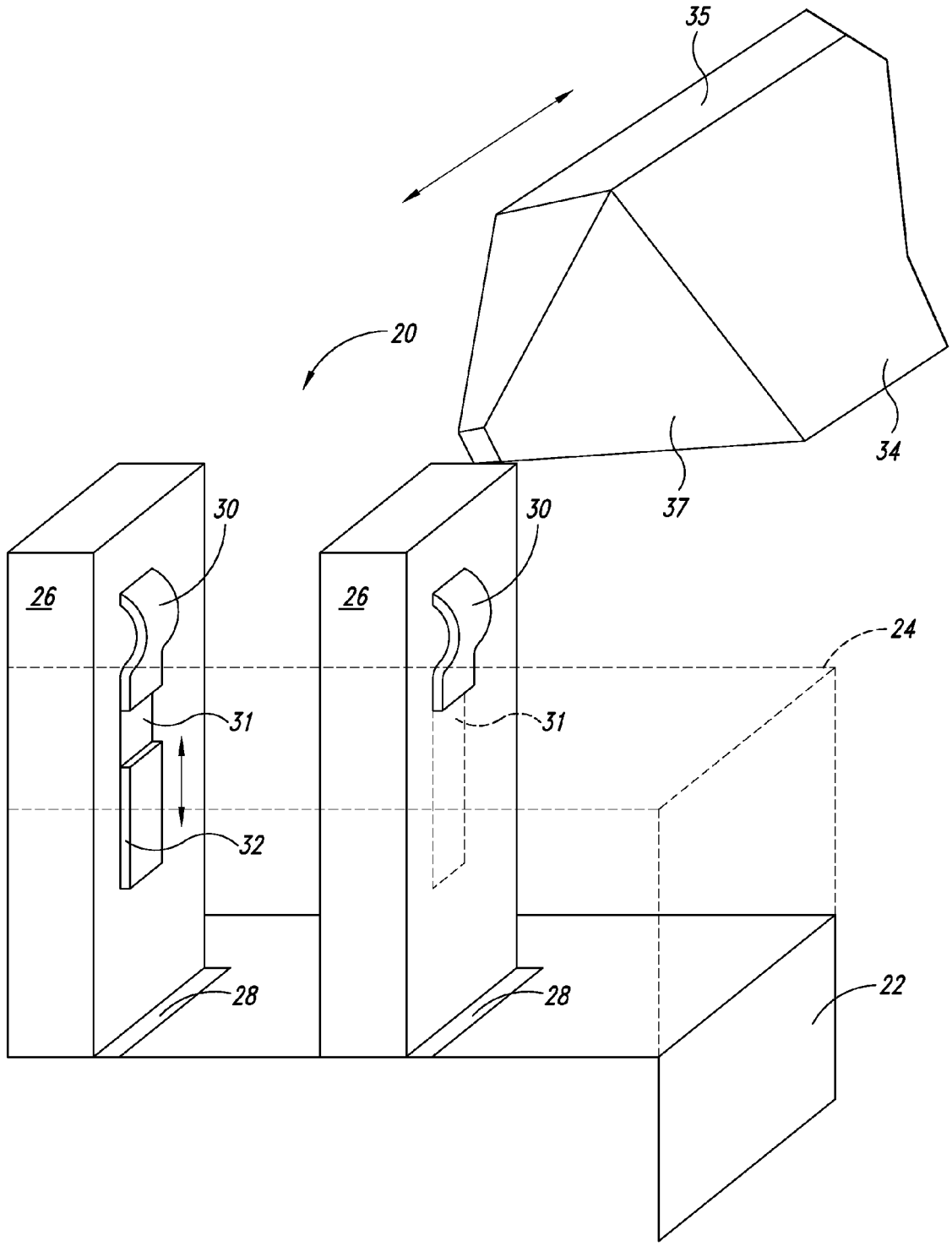
FIG. 1 is an isometric view of a first embodiment of a locking socket adaptor formed in accordance with the present disclosure.
Figure 3:
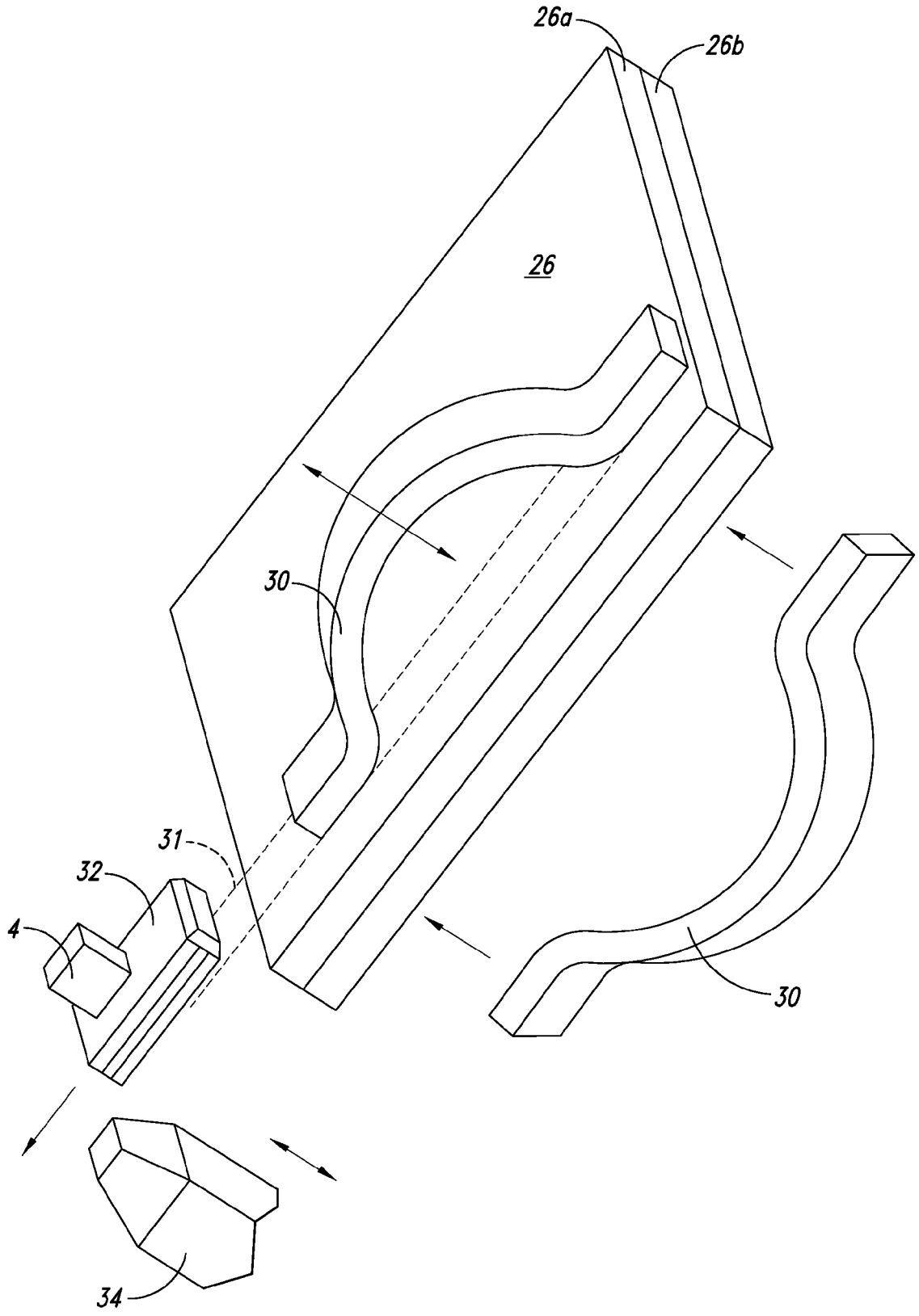
FIG. 3 is an isometric view of the movement of the wedge of FIG. 1.

FIG. 1 shows two prongs 26 protruding from the body 22 of the LSA 20. FIG. 1 also shows a wedge 34 that may be forced between the two prongs 26 inside a housing portion 24 of the LSA 20, which causes two actions to take place. The first action is to push apart the two prongs 26. The second action (as shown in FIG. 3) is to force the wedge 34 underneath a sliding bar 32, where each of the prongs 26 is coupled to a respective sliding bar 32. The sliding bars 32 are driven into the ends of two tabs 30 as the wedge 34 is forced underneath them. The two tabs 30 are connected to the two prongs 26, respectively, and are placed on both sides of each of the prongs 26. The two tabs 30 bulge as the wedge 34 slides underneath the two tabs 30. The bulging portion of the two tabs 30 is outside of the housing 24 of the LSA 20, but the contact between the sliding bars 32 and the tabs 30 happens inside the housing 24 of the LSA 20 on a track 31. The LSA 20 also has openings 28 that allow the prongs 26 to deflect.

As shown in FIG. 1, the wedge 34 has a body 35 with a four-sided pyramid-shaped head 37. Alternatively, the wedge 34 may be ramped-shape, such that one side is flat and the opposing side is formed at an incline. At one end of the wedge 34, the side opposing the flat side forms a tip where the thickness of the wedge 34 is small, and at the other end of the wedge 34, the side opposing the flat side forms a rectangular end where the thickness of the wedge 34 is larger than the other end.

Figure 2:
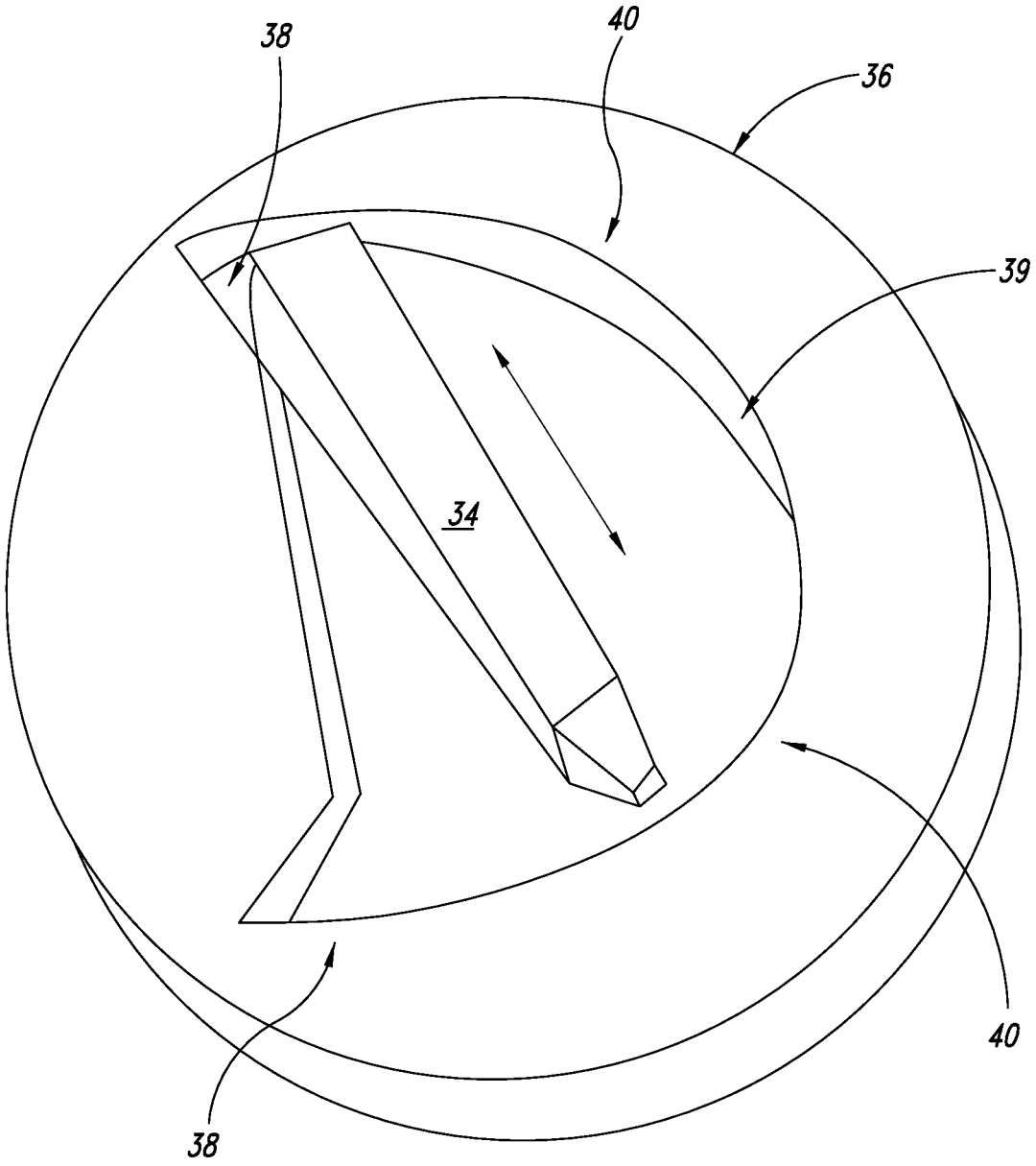
FIG. 2 is an isometric view of a wedge shown in FIG. 1.
Figure 9:
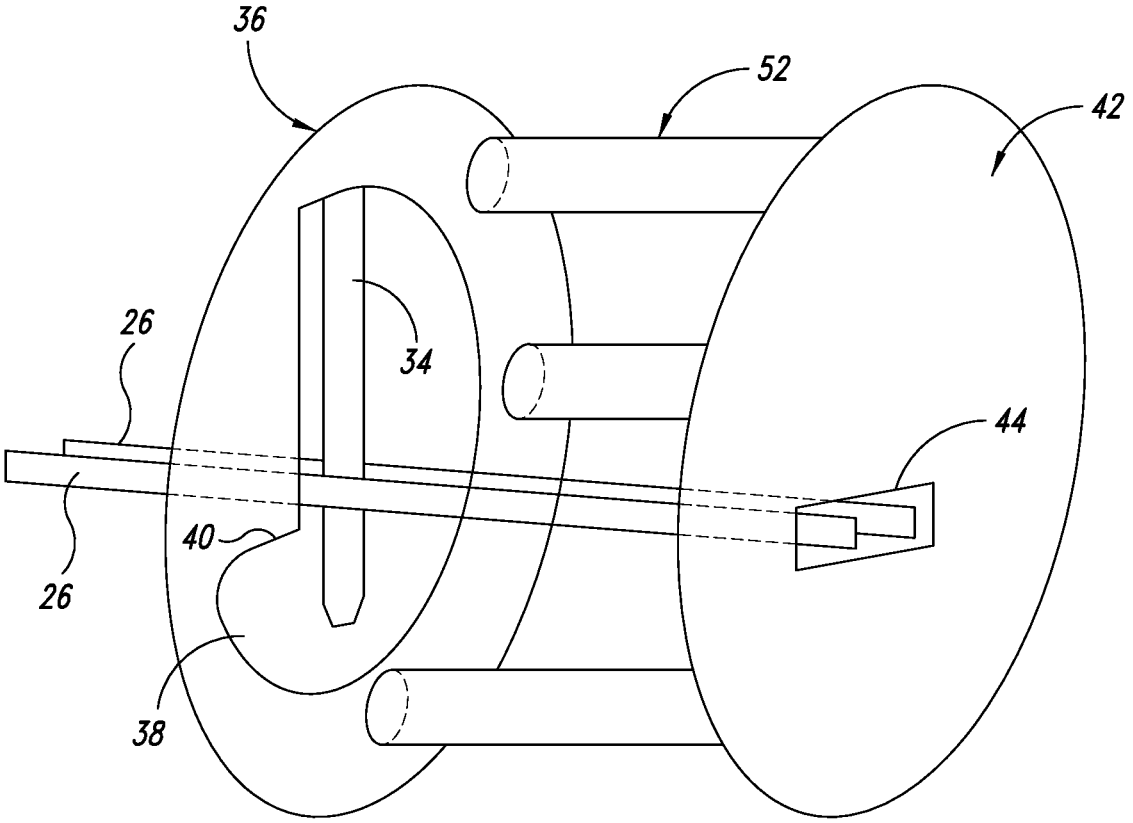
FIG. 9 shows the cams coupled through connection members in the device of FIG. 1.

In both embodiments, the wedge 34 is free to move as indicated by the arrows in FIG. 2 but remains positioned inside the cam 36. As the cam 36 moves, thicker portions 39, 40 of the cam 36 make contact with the wedge 34 and force the wedge 34 to move in between the prongs 26, as shown in FIG. 9. The prongs 26 hold the wedge 34 on at least two sides and force the wedge 34 to follow a linear path as the cam 36 is turned. The inclined surfaces of the wedge 34, such as the pyramid-shaped head 37, make contact with the sliding bars 32 and, due to the incline, move the sliding bars 32 up and down within the track 31. Thus, as the cam 36 turns and forces the wedge 34 to move, the incline surfaces of the wedge 34 may make contact with the sliding bars 32 and force them up (or down), which further causes the sliding bars 32 to make contact with the tabs 30, as described herein.

Figure 4A:
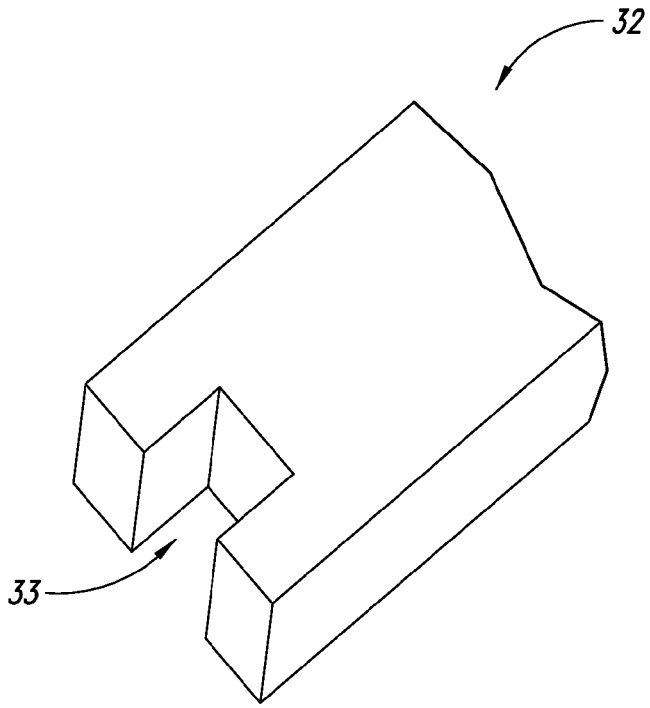
FIGS. 4A and 4B show further details of the sliding bars of FIG. 1.
Figure 4B:
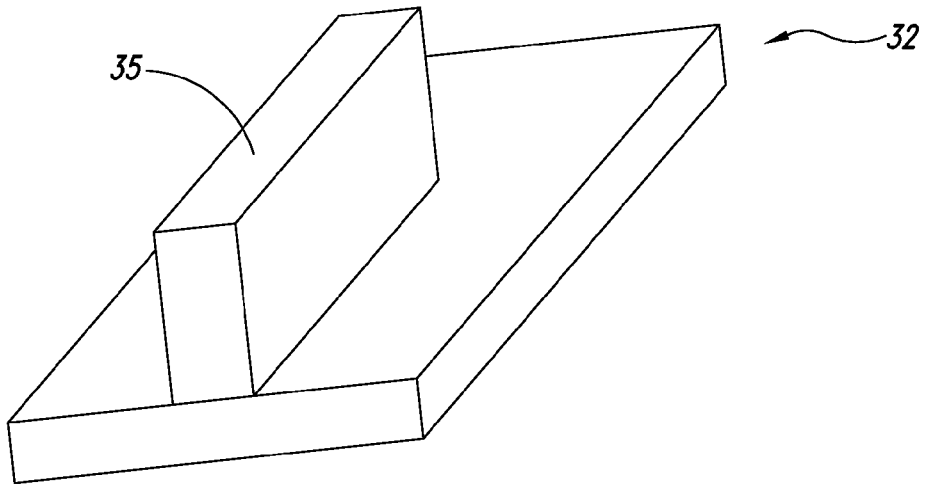
Figure 5A:
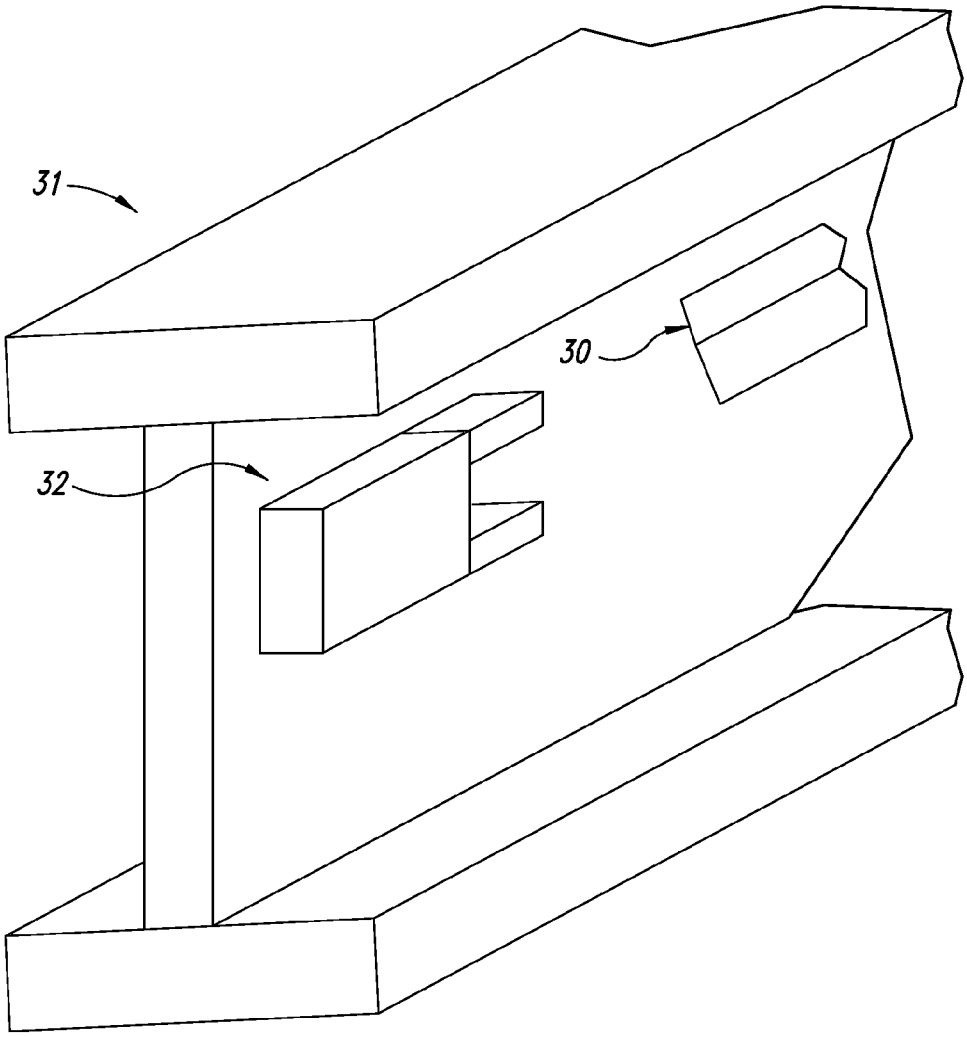
FIGS. 5A-5C show the tabs and tracks in the prongs of the device of FIG. 1.
Figure 5B:
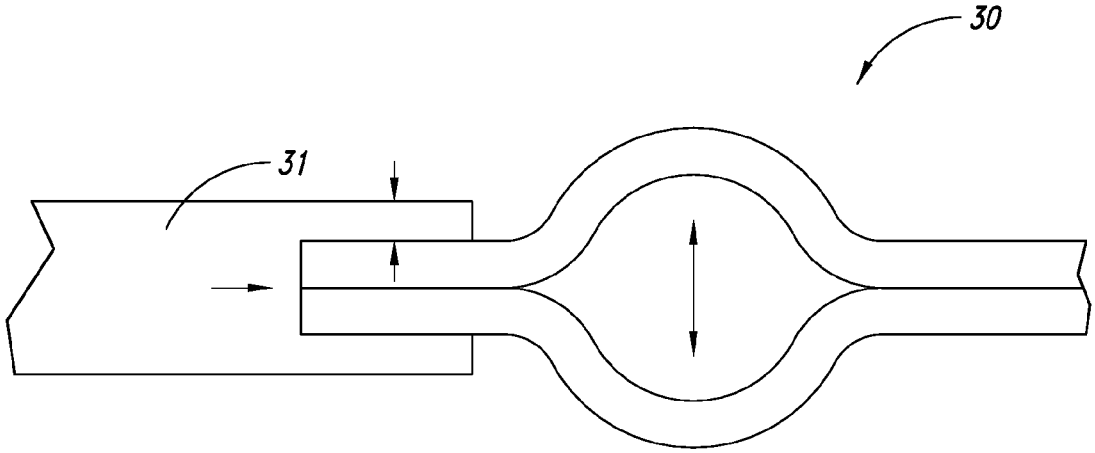
Figure 5C:
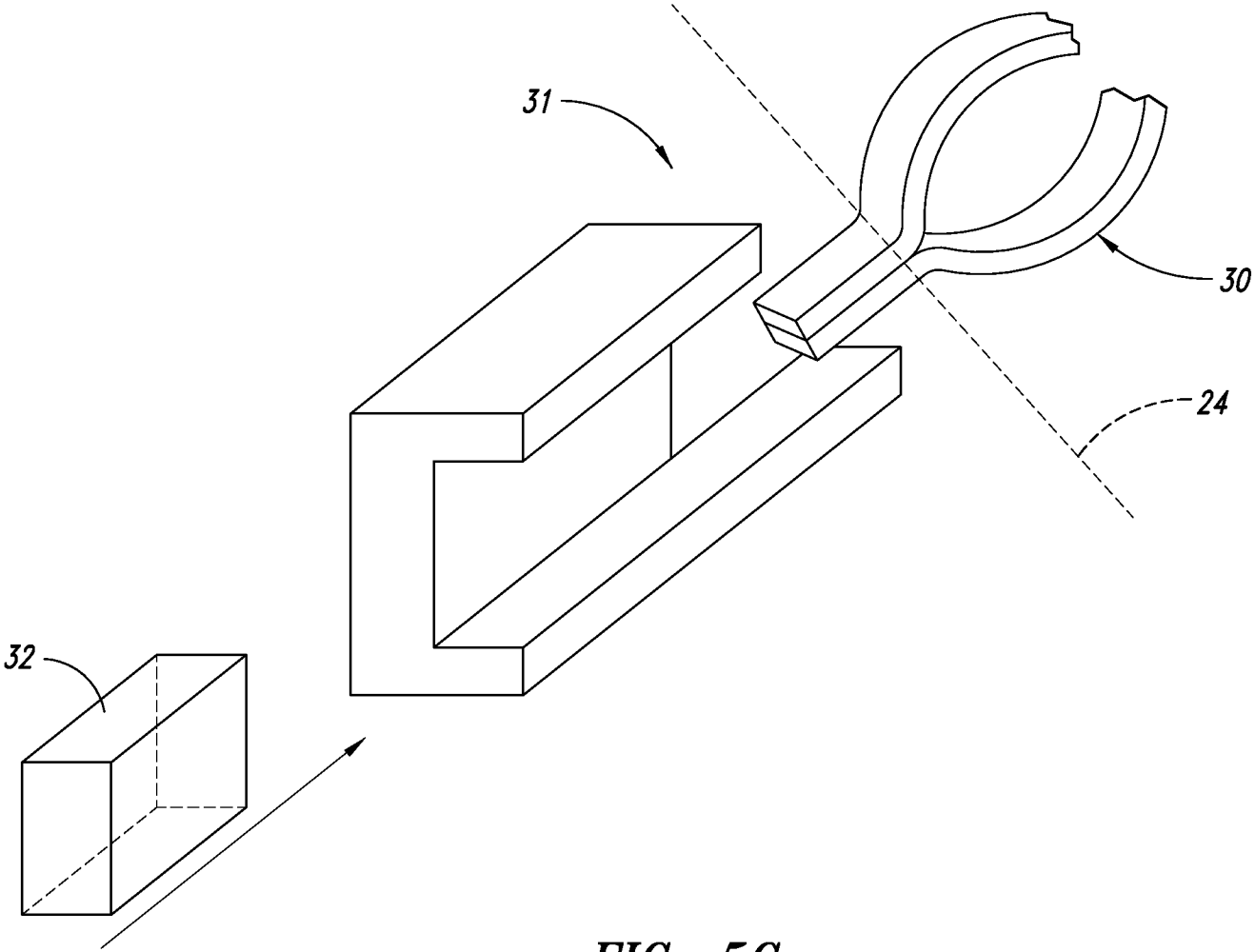

FIGS. 4A and 4B show further details of the sliding bars 32. At the end of each of the sliding bars 32 that make contact with the tabs 30 is a slot 33, as shown in FIG. 4A, of such size as to capture the tabs 30 and securely hold them while the wedge 34 slides underneath the two tabs 30. The sliding bars 32 run along tracks 31, as shown in FIGS. 5A and 5B, which are formed within the prongs 26. FIGS. 5A and 5B show examples of the track 31 in which each of the sliding bars 32 (as shown in FIG. 4B) move. The sliding bars 32 have a side projection 35 that makes contact with the wedge 34.

As further shown in FIGS. 5A and 5B, the ends of the tabs 30 that reside inside the prongs 26 fit and run within the track 31. As the wedge 34 engages with the sliding bars 32 due to turning of the cam 36, the sliding bars 32 are forced along the track 31 towards the tabs 30. The sliding bars 32 have the slot 33 that interacts and holds the ends of the tabs 30 that reside within the prongs 26. Alternatively, the slot 33 may be a flat portion or other shape of the respective sliding bar 32 so long as the slot 33 makes contact with the associated tab 30.

As the slot 33 holds the tabs 30 and the wedge 34 is further moved by the cam 36, the tabs 30 are forced along the track 31. However, because the tabs 30 are each fixed at one end opposite the ends that are held by the slot 33, the tabs 30 begin to bulge, as shown in FIGS. 5A, 5B, and 7B. The bulging portion of the tabs 30 makes contact with the metal plates within the outlet and reestablishes electrical contact.

In order to make the wedge 34 move and push the sliding bars 32 and separate the prongs 26, the cam 36, as shown in FIG. 2, is turned, for example, by approximately ⅓ of a turn. The wedge 34 is moved by the cam 36 in a straight line back and forth depending on which direction the cam 36 is turned. FIG. 2 shows the wedge 34 in the unlocked position. At the top and bottom of the cam 36 as positioned in FIG. 2, there are recesses 38 that press against the wedge 34 as the cam 36 turns, thus engaging the wedge 34 to prevent further movement of the cam 36. There is also shown in FIG. 2 the thicker portion 38, 40 of the cam 36 that, as the cam 36 is turned, makes contact with the wedge 34 and forces the wedge 34 to move along the directions of the arrow.

As the cam 36 is turned counterclockwise, the wedge 34 is driven between the prongs 26 because the thickness of the cam 36 is increasing, as shown in FIGS. 2 and 9. After the cam 36 is turned in a counterclockwise direction, the wedge 34 is moved a distance required to spread the prongs 26 apart and push the sliding bars 32 into the tabs 30, as shown in FIG. 9.

Figure 6A:
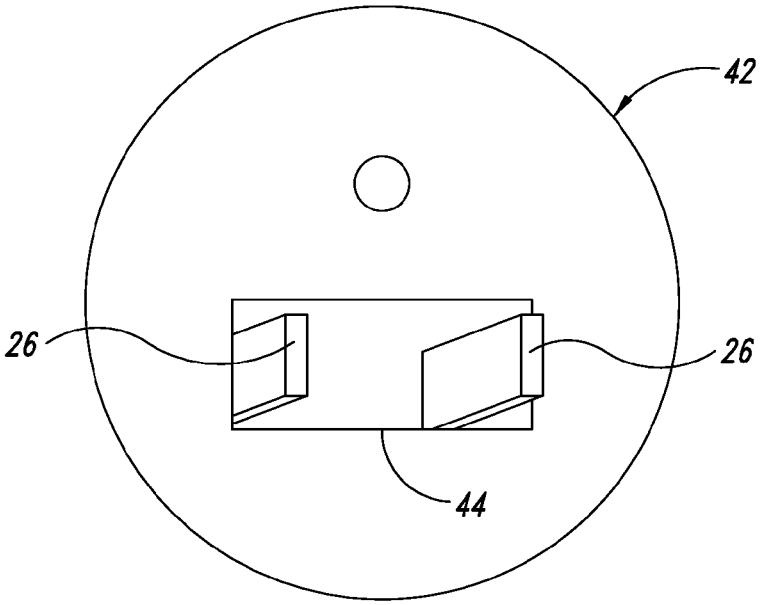
FIGS. 6A-6C show the movement of the prongs of the device of FIG. 1.

Conversely, a clockwise turn of the cam 36 will make the bottom portion of the cam 36 as oriented in FIG. 2 come in contact with the wedge 34 and push the wedge 34 back. The thickness of the wedge 34 between the prongs 26 reduces as the cam 36 is turned clockwise and the prongs 26 return to a resting position as do the sliding bars 32 and the tabs 30. FIG. 6A shows a cam 42 that is coupled to the cam 36, as shown and described with regard to FIG. 9. The cam 42 turns in unison with the cam 36. When the cam 42 is turned, an opening 44 causes the prongs 26 to perform a scissor-like action, which further holds the LSA 20 in an outlet.

Figure 6B:
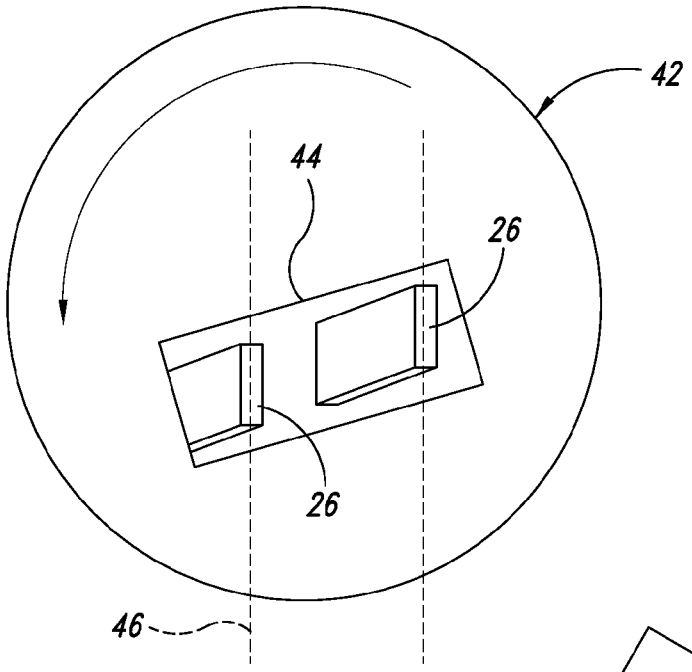
Figure 6C:
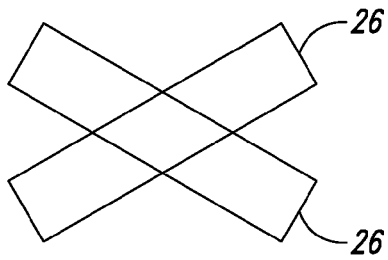

FIG. 6B shows how the prongs 26 stay in the same plane 46 while the cam 42 is rotated in a counterclockwise direction. The net result of the cam 42 turning in the counterclockwise direction is to cause one prong of the prongs 26 to rise while the other prong drops. FIG. 6C shows a side view of the scissor-like action the prongs 26 make as the cam 42 is turned.

Figure 7A:
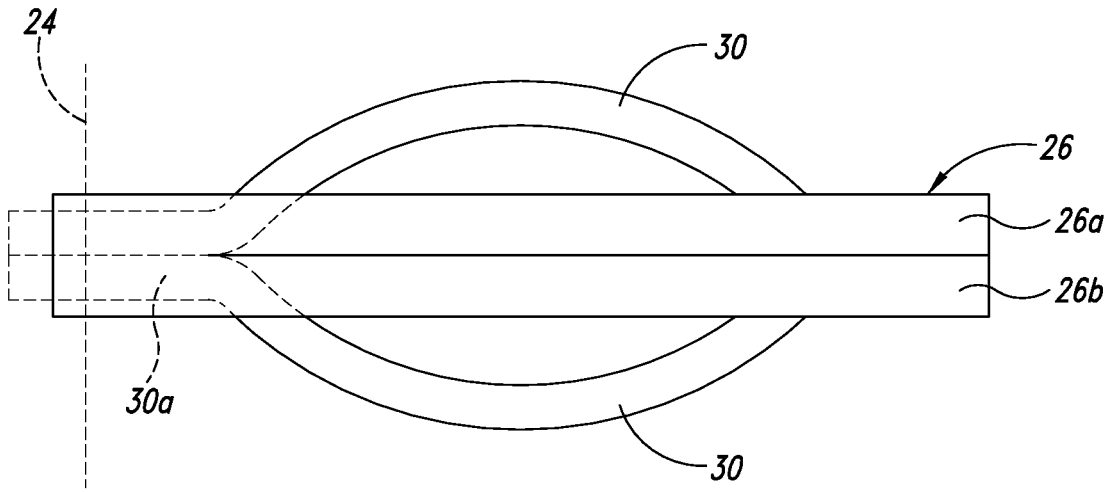
FIGS. 7A-7B illustrate the bulging of the sidewalls of the tabs of the device of FIG. 1.
Figure 7B:
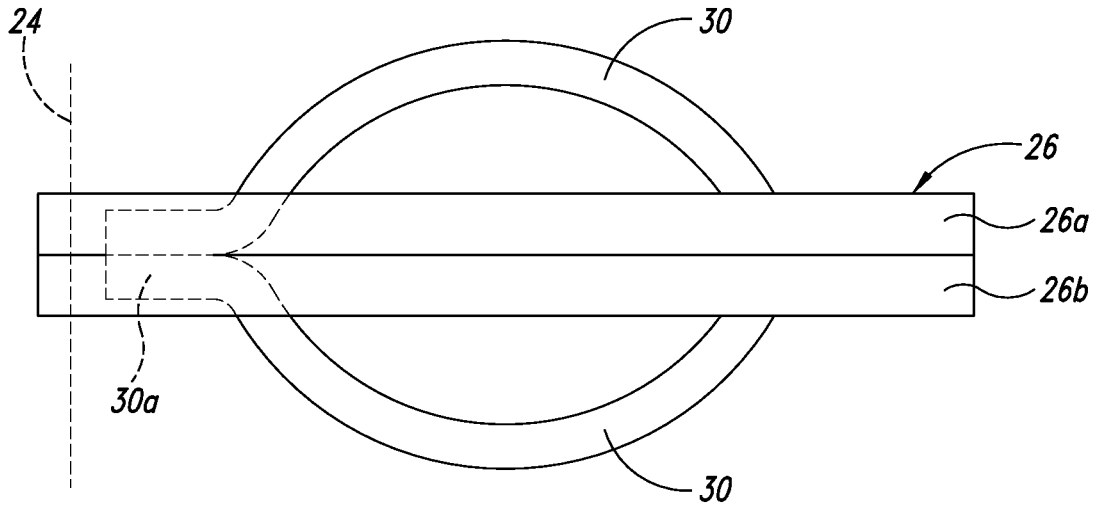

FIG. 7A is a side view of one of the prongs 26 with the tabs 30 attached. Each of the prongs 26 is made of a first piece 26A and a second piece 26B. In an alternative embodiment, the prongs 26 are each formed of a single piece that is folded over onto itself.

At one end of the prong 26 in FIG. 7A, the tabs 30 are physically attached to the prong 26 but reside outside the prong 26. For example, as shown in FIGS. 7A and 7B, the tabs 30 curl from the attached ends to the ends that reside within the prongs 26. At the other end of the prongs 26, the tabs 30 are detached but reside inside the prongs 26 between the first piece 26A and the second piece 26B. The tabs 30 are held by the track 31, thus keeping the tabs 30 inside the prongs 26 as the tabs 30 run inside and along the track 31.

After the prongs 26 of the LSA 20 are inserted into an outlet, the tabs 30 may have a force exerted upon them due to the internal connections of the outlet, such as metal plates. However, if the outlet has internal connections that are separated, then the tabs 30 may not make contact. To reestablish electrical contact between the prongs 26 and the metal plates within the outlet, the cams 36 and 42 are turned. As previously described, the cam 36 pushes the wedge 34 into the sliding bars 32, which are pushed into the tabs 30 causing a bulge to form on each of the tabs 30, as shown in FIG. 7B. The bulges of the tabs 30 press against the metal plates within the outlet to reestablish electrical connection.

At the same time, the cam 42 is turned causing the prongs 26 to perform the scissor-like action and end in a configuration as shown in FIG. 6C. Because the prongs 26 are now positioned at an angle with respect to the entrance of the outlet, the prongs 26 will physically stop the LSA 20 from being pulled out of the outlet. In this embodiment, the prongs 26 act as a lock to prevent the removal of the LSA 20. In an alternative embodiment, the prongs 26 do not act as a lock but rather as an extra securing mechanism that prevents removal of the LSA 20 if a relatively weak force is applied. However, if someone trips over the cord attached to the LSA 20, for example, the prongs 26 will not prevent the LSA 20 from being pulled out of the outlet. This helps to prevent the LSA 20 from remaining in the outlet if someone trips over the cord while the electronic device to which it is attached is pulled onto the floor, causing damage to the electronic device or damage to the outlet.

Figure 8A:
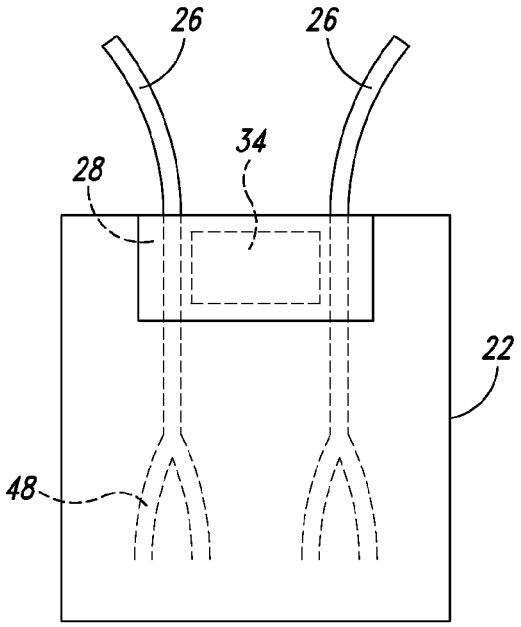
FIGS. 8A-8D illustrate the action of the prongs of the device of FIG. 1.
Figure 8C:
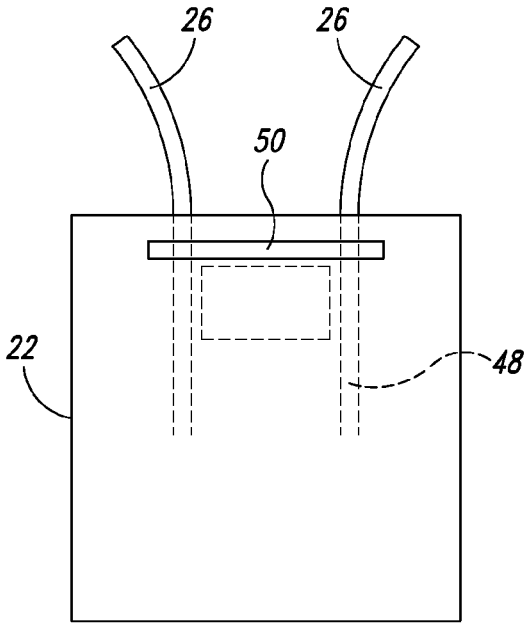
Figure 8B:
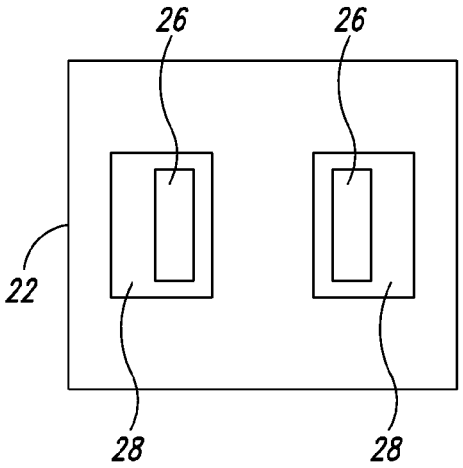

FIG. 8A shows a side view of how the prongs 26 are bent apart by the wedge 34. FIG. 8B shows a top view of how the prongs 26 are bent apart by the wedge 34 and the spaces 28 that are allotted for the deflection of the prongs 26. FIG. 8C shows a pin 50 that passes through both prongs 26 and extends a sufficient distance within the body 22 of the LSA 20 so that the wedge 34 may cause the prongs 26 to deflect. The pin 50 is structured to supply a pivot point for the prongs 26 and is similar to the pin that is used as the axis for a pair of scissors to open and close.

Figure 8D:
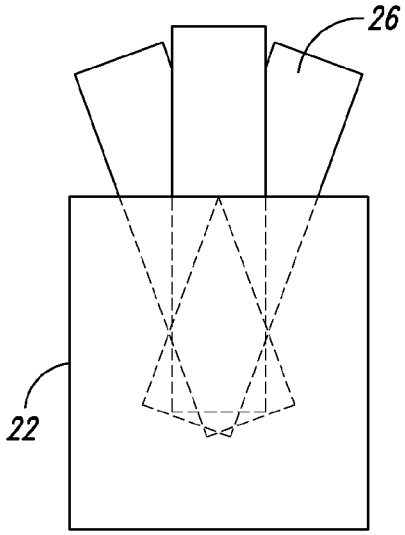

The prongs 26 slide sideways, as shown in the side view of FIG. 8C, along the pin 50. The pin 50 is anchored in the housing 22 of the LSA 20 at two ends. Since the housing 22 of the LSA 20 confines a lower portion of the prongs 26, the upper portion of the prongs 26 can bend when the wedge 34 exerts a force on the prongs 26. Because the amount of deflection required to reestablish electrical contact with the metal plates within the outlet is small compared with the dimensions of the prongs 26, the prongs 26 will bend back and forth with minimal loss to their shapes. FIG. 8D shows another side view of the LSA 20 in which the prongs 26 perform a scissor-like action, as described above.

FIG. 9 shows the cams 36, 42 coupled through connection members 52. The cams 36, 42 may be connected with three connection members 52 or with more and larger connection members 52. The cams 36, 42 are separated to provide both strength and optimal use of space within the housing 22 of the LSA 20, yet still permit the prongs 26 to move as described above.

Figure 10A:
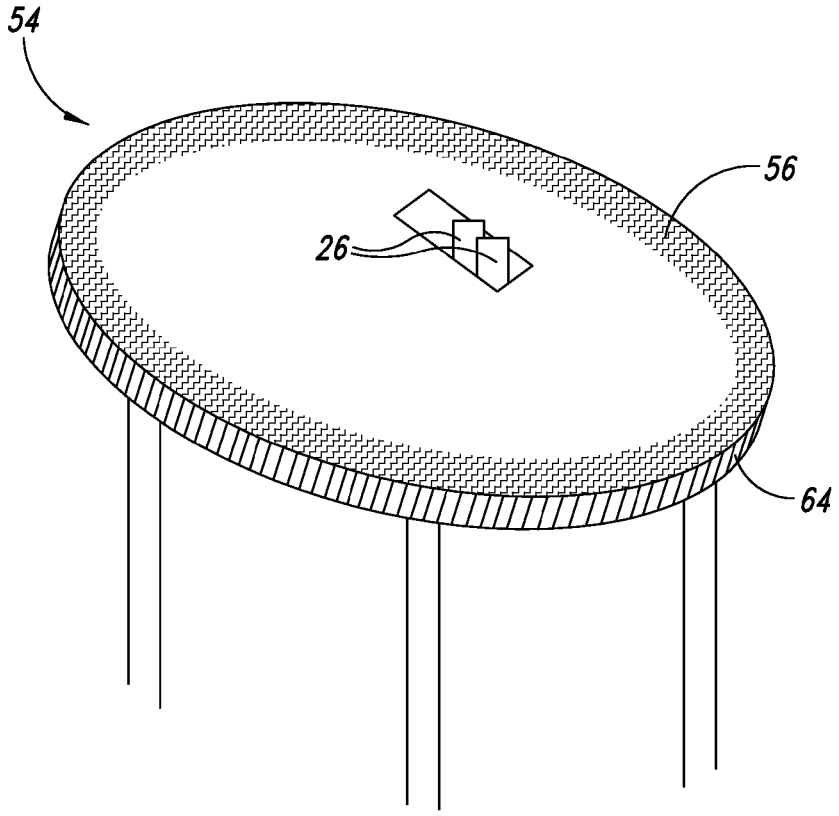
FIGS. 10A-10B illustrate the cam with teeth in accordance with another embodiment of the present disclosure.
Figure 10B:
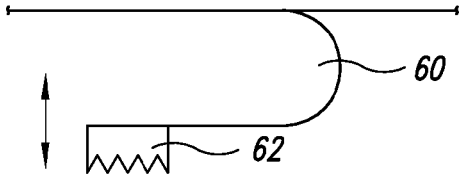

FIG. 10A shows a cam 54 with teeth 56 embedded along the face of the cam 54 and grooves along the outside edge of the cam 54. The teeth 56 work in conjunction with a bent connection member 60 that also has teeth 62 as shown in FIG. 10B. The bent connection member 60 acts like a spring that matches the teeth 62 with the teeth 56. The end of the bent connection member 60 without the teeth 62 is attached to the housing 22 of the LSA 20. The end of the bent connection member 60 with the teeth 62 and the portion that is bent back upon itself is free to move. The cam 54 is gripped and turned by hand on the outside of the LSA 20. As the cam 54 is turned, the teeth 62 of the bent connection member 60 bump in and out of the teeth 56 of the cam 54. When the cam 54 has stopped turning, the teeth 62 of the bent connection member 60 settle in with the teeth 56 of the cam 54 due to the spring-like nature of the bent connection member 60. The spring-like action of the bent connection member 60 is not strong, however. As a result, disengaging the teeth 62 of the bent connection member 60 and the teeth 56 of the cam 54 requires only a small amount of effort. Once the cam 54 has been turned back to its starting position it will automatically hold in place. The teeth 56 on the cam 54 do not need a release button to disengage the cam 54 from the bent connection member 60. Instead, only a small effort is required to overcome the stopped position held by the teeth 56, 62. The grooves 64 formed along the outside edge of the cam 54 allow a user to grip and turn the cam 54.

Figure 11:
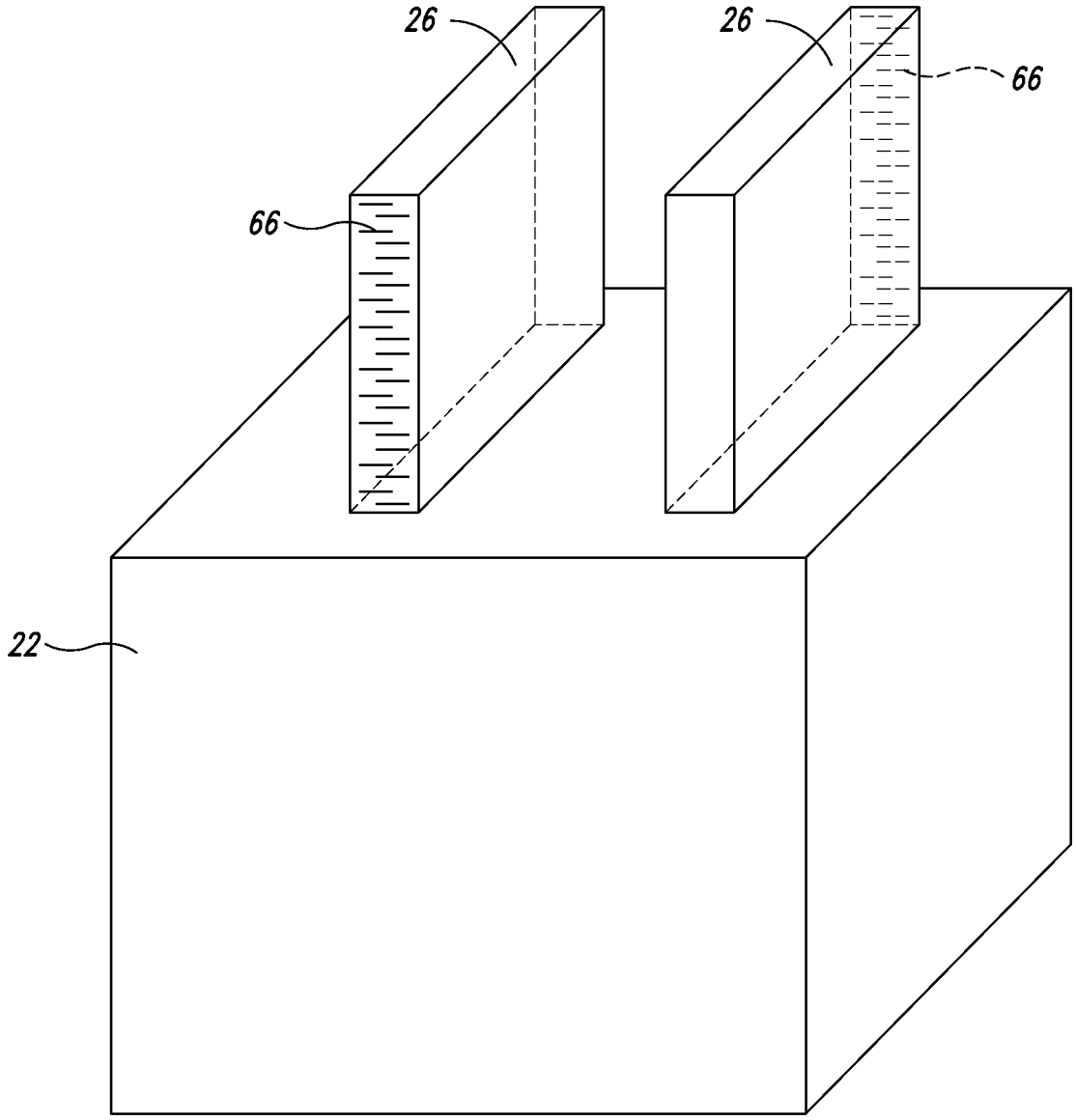
FIG. 11 shows the prongs with serrated edges in accordance with another aspect of the present disclosure.

FIG. 11 shows serrated edges 66 formed near the ends of the prongs 26. The serrated edges 66 give the prongs 26 additional holding power once the prongs 26 have been inserted into an outlet and the scissor-like action has been engaged. For example, the serrated edges 66 will interact with the inside of the outlet slot such that the serrated edges 66 act like small teeth that catch and help to reduce the LSA 20 from being pulled out of an outlet. If an effort is made to pull the LSA 20 out of the outlet, the serrated edges 66 will provide additional drag or friction, thus providing more holding power.

Figure 12:
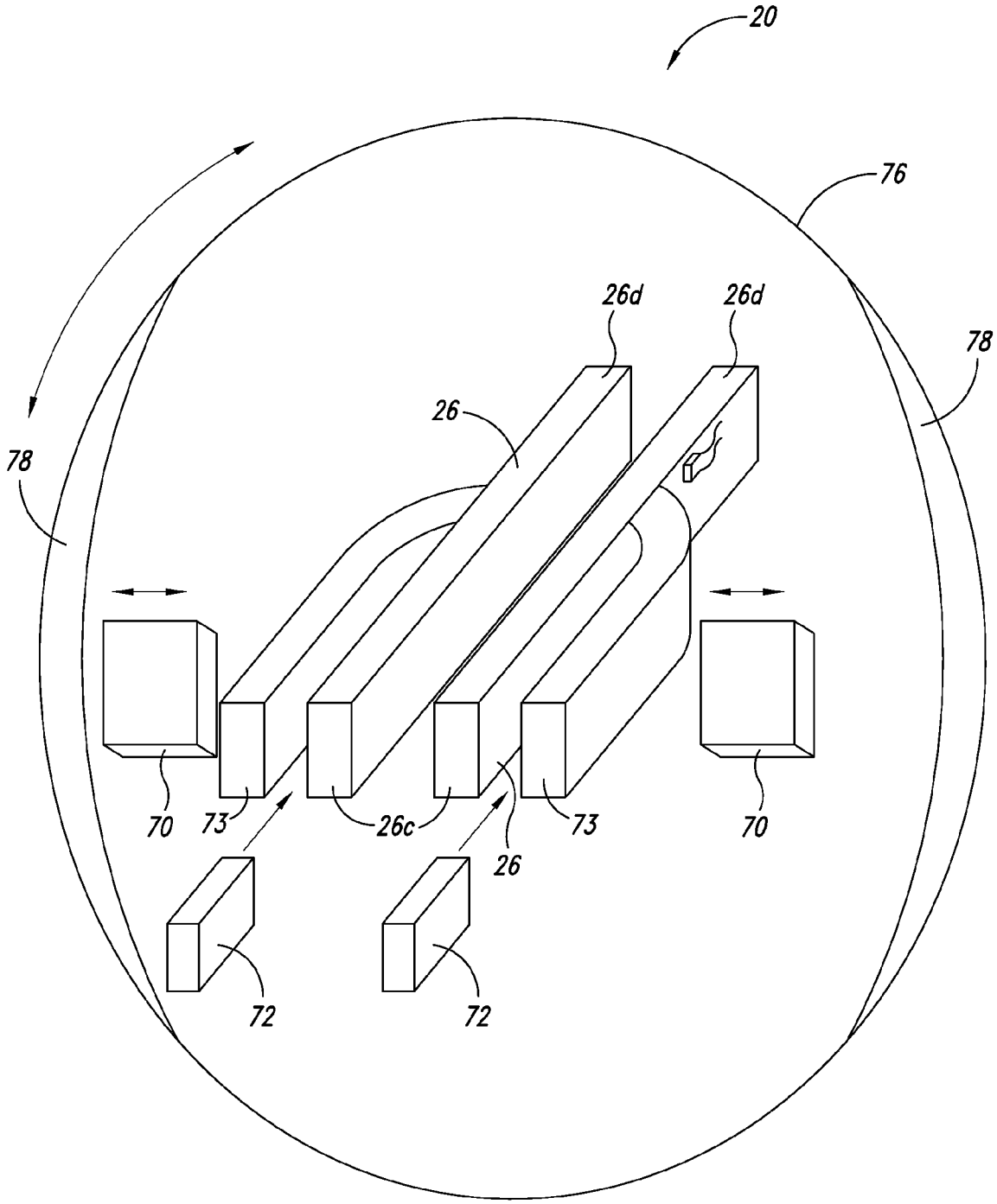
FIG. 12 shows the cam coupled to the female end of an adaptor formed in accordance with another embodiment of the present disclosure.

FIG. 12 shows a female end of the LSA 20 with ends 26C, which are opposite to the male ends 26D. The ends 26C and 26D form the ends of the prongs 26. Prongs 72, such as from a traditional plug of an electrical device to which power is to be supplied, may be inserted into the female end of the LSA 20. When the prongs 72 are inserted, the bars 70 may be pushed toward the side of moveable pieces 73 and sandwich the prongs 72 between the two ends 26C at the female end of the LSA 20 and the moveable pieces 73. This process is done by the use of a cam 76, which when turned clockwise or counterclockwise, pushes the bars 70.

FIG. 12 further shows the cam 76 as coupled to the female end of the LSA 20. Turning the cam 76 causes the thicker portions 78 of the cam 76 to come into contact with and force the bars 70 toward the ends 26C. As the bars 70 move inward, the moveable pieces 73 are forced toward the ends 26C and eventually sandwich the prongs 72 with the ends 26C. Turning the cam 76 in the other direction will then free the prongs 72 from being sandwiched and releasing pressure from the prongs 72 and the moveable pieces 73. As the cam 76 is turned, the thicker portions 78 allow the spring-like force of the moveable pieces 73 to force the bars 70 outward. The cam 76 can be turned like the other cams 36, 42 that lock the prongs 26 of the LSA 20 to the outlet using the same mechanism, for example, as shown in FIGS. 10A and 10B.

All parts of the LSA 20 may be made out of plastic or other insulating material except the prongs 26 and the tabs 30, which are made out of an electrically conducting material, such as brass or some other metal alloy. Additionally, the cams 36, 42, 54, 76 may be made out of a flexible material, such as a soft plastic, to allow for sufficient deformation should the LSA 20 be subject to a large external force, for example, if someone trips of the cord attached to the plug coupled to the LSA 20.

Figure 13:
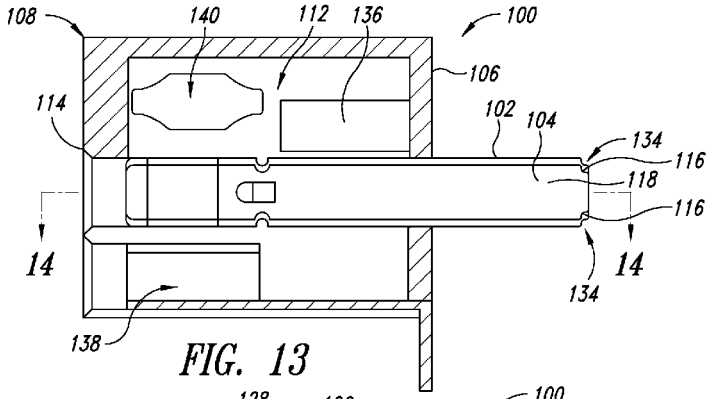
FIGS. 13 and 14 are cross-sectional side and top views respectively of another embodiment of an adaptor formed in accordance with the present disclosure.
Figure 14:
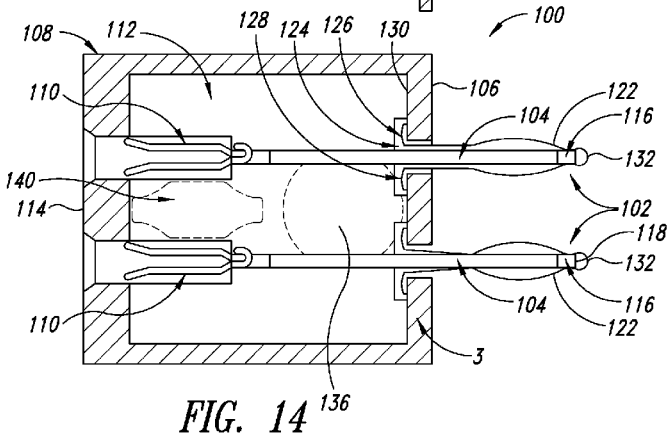
Figure 15:
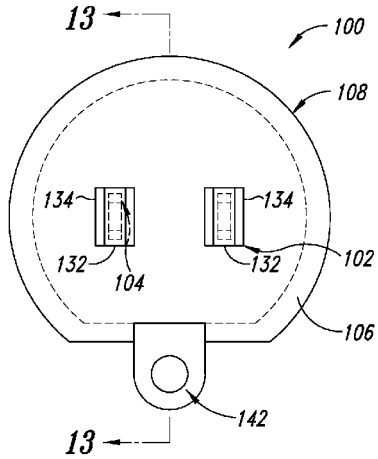
FIG. 15 is an end view of the adaptor of FIGS. 13 and 14.
Figure 16:
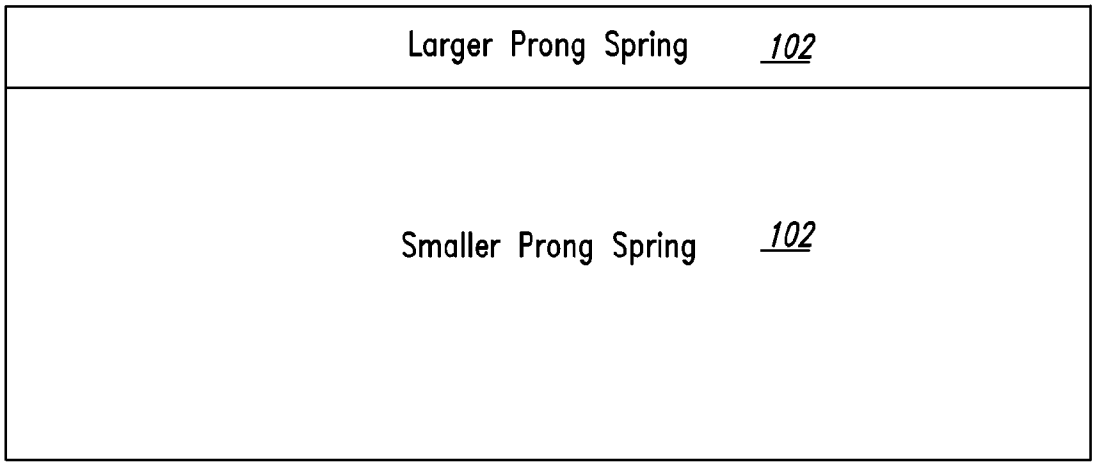
FIGS. 16 and 17 are side and top views, respectively of the prong springs from the adaptor of FIGS. 13-16.
Figure 17:
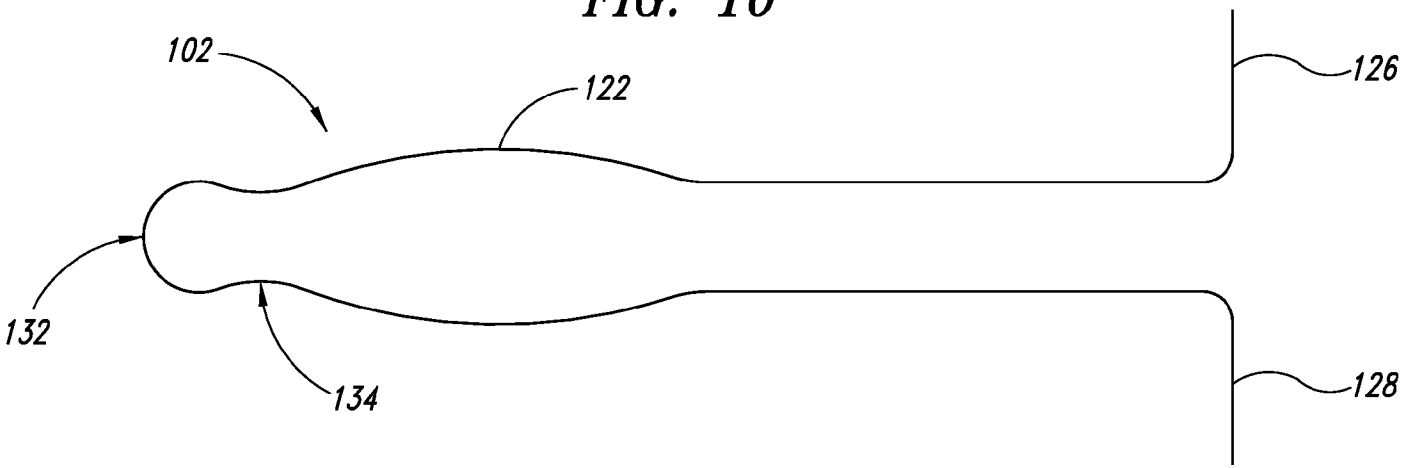

FIGS. 13-15 illustrate yet a further embodiment of the present disclosure in which an adaptor device 100 includes an adaptor body 108 having unique prong springs 102 received over prongs 104 that extend from a first end 106 of the adaptor body 108. The adaptor body 108 has a pair of metal receptacles 110 extending into an interior 112 of the body through an opposing second end 114 of the body and that are adapted to receive prongs from an external plug (not shown) in a conventional manner. The receptacles 110 are of a conventional design and are electrically coupled to the respective pair of prongs 104. Each prong 104 is also of a conventional design that includes a "dimple" or cut-out section 116 at opposing lateral corners on the distal tip 118.

Fitted over each prong 104 is the metal prong spring 102 that has a pair of flexible side walls 122 shaped to bulge outward or away from the corresponding side wall 122 of the prong spring 102. This also bulges away from the side of the corresponding prong 104. Each prong spring 102 is essentially U-shaped and has a proximal end 124 on which is formed a leg 126, 128 that projects at substantially a right angle away from the adjacent sidewall 122 and matching leg 126, 128. These legs 126, 128 bear against an inside surface 130 of the first end 106 of the adaptor body 108 to retain the prong spring 102 in fitted engagement over the respective prong 104.

To prevent lateral side movement of the prong spring 102 relative to the prong 104, the terminal tip 132 that connects the side walls 122 of the prong spring 102 together has opposing lateral corners 134 that are crimped in a manner to fit into the cut-out sections 116 of the prong 104. The combination of the legs 126, 128 bearing against the inside surface 130 of the adaptor body 108 and the engagement of the crimped lateral corners 134 with the prongs 104 holds the prong spring 102 in place. However, there is sufficient play between the legs 126, 128 and the adaptor body 108 that allows the legs 126, 128 to move relative to the adaptor body 108 in response to compression of the bulging sidewalls 122 when the adaptor 100 is inserted into a wall receptacle.

An example of the material that can be used for the prong spring 102 is a special alloy that has both properties required for this application, i.e., a good conductor of electricity and a good spring metal. The Olin Corporation has available spring metal that meets these requirements. Another solution is a spring steel coated with a thin layer of copper. In essence any material that conducts electricity and also acts as a spring will serve the purpose required for the adaptor 100.

The thickness required by ANSI for the prongs 104 is 0.06 inches. The thickness of the prong spring 102 would be in the range of about 0.003 to 0.015, and since the prong 104 (for example a strong solid brass) would be "capped" or "covered" by the prong spring 102, the prong 104 thickness could range from 0.030 inches to 0.054 inches. The combined thicknesses of the prong 104 and the prong spring 102 would equal 0.06 inches, as for example 0.005+0.005+0.05=0.06 inches.

In the event the adapter overheats due to a faulty receptacle or for any other reason, an Automatic Reset Thermostat (ART) 136 as described more fully below could be used to temporarily interrupt the flow of current. Until the temperature returns to a safe temperature, the adapter 100 will remain "off" in that the pair of prongs 104 will not have continuity to be able to conduct electricity.

Another safety device can be provided for the possible occurrence of a "short" in the flow of electricity. An example would be if someone were to cut through an electrical cord with a power saw. In one embodiment, a glass cartridge fuse 138 would be used to stop the flow of electricity. This fuse would be small and accessible for replacement in the event the fuse is blown. Such fuses are conventionally known and will not be described in detail herein.

The body 108 of the adapter 100 could be made of a clear plastic form of FRP or some other form of clear plastic such that a neon light 140 can be housed inside the adapter 100 and lit up to let the user know that the adapter 100 is functional when plugged into an electrical socket.

When prongs from an external plug are inserted in between the two flat metal plates of the pair of receptacles 110 at the female end 114 of the adaptor 100. The external plug prongs will be compressed in place by the surrounding FRP plastic that houses these two flat metal plates. If a cam were to be used, the user would turn the cam, which would in turn apply pressure to the two plates in the female end 114 of the adaptor 100, which would in turn "squeeze" the external plug prong, as described above in connection with the prior embodiments.

An Automatic Reset Thermostat (ART) 136 can be completely housed inside the adaptor body 108 and configured to accept the "hot" prong 104 in two ways. The first way is to allow the flat portion of the prong 104 to rest on top of the ART. The function of this portion of the ART 136 is to detect the temperature of the prong and initiate an electrical disconnect if the temperature exceeds what is deemed to be a safe level. The portion of the prong that rests flat on top of the disc shaped ART 136 is reduced in size (as compared to the portion of the prong 104 seen outside the adaptor body 108), thus creating a slight bottleneck for the electricity passing through on its' way to the female end 114. The purpose of this design is to assure that this would represent that portion of the prong 104 that would heat up first, thus causing the ART 136 to "turn off" the electricity when the temperature exceeds an acceptable level. After passing over the flat top of this ART disc, the prong 104 continues on and connects with the first of two electrical posts which force the electricity to pass through the body of the ART 136.

If the ART 136 senses the metal to be too hot, the flow of electricity is interrupted inside the body of the ART and does not continue on to the other post on the other side ART 136, thus interrupting the circuit.

The neon light 140 is placed "downstream" of the ART 136 and is connected to both the hot and neutral lines and comes with a resistor. Its sole purpose is to light up and indicate that the adaptor 102 is electrically charged.

A ground "eye" 142 is provided to allow for a ground screw to fasten the adaptor 100 to a receptacle. This can be done by using the existing screw that holds the faceplate cover to the receptacle or by removing the faceplate cover of the receptacle, thus exposing the screw hole by which a screw can pass through the ground "eye" and fasten the adaptor 100 to the receptacle.

The glass cartridge fuse 138 would be downstream of the ART 136 and simply intercepts the path of the "hot" wire, forcing the electricity to pass through its' housing and performing its function whenever there is a short, effectively stopping the flow of electricity.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An adaptor device, comprising:

a body having an interior;

a pair of prongs extending from the body in spaced parallel relationship, each prong having a distal end with opposing corners, each opposing corner having a cut-out portion;

a pair of receptacles extending into the interior of the body, each receptacle structured to be in electrical contact with a respective prong of the pair of prongs; and a pair of prong springs received over the pair of prongs, each prong spring having a pair of flexible side walls that are structured to bulge outward away from the prong, each prong spring having a distal terminal tip on each side wall, the terminal tip having opposing lateral corners that are crimped to fit within the cut-out portion of a prong on which the prong spring is mounted to prevent lateral movement of the prong spring relative to the prong.

2. The device of claim 1, wherein each side wall of the prong springs has a proximal end and each side wall has a leg extending from the proximal end of the side wall, each leg configured to cooperate with the body to retain the prong spring on the respective prong.

3. A device, comprising:

a body having an external wall and an interior;

a pair of prongs extending outward from the interior of the body in spaced parallel relationship, each prong having a distal end with opposing corners, each of the opposing corners having a cut-out portion;

a pair of receptacles extending into the interior of the body and electrically coupled to the pair of prongs; and a pair of prong springs, each prong spring received over a respective prong of the pair of prongs, each prong spring having a pair of flexible side walls that are structured to bulge outward away from the prong, each prong spring having a terminal tip on the side walls, the terminal tip having opposing lateral corners that are crimped to fit within the cut-out portion of a prong on which the prong spring is mounted to prevent lateral movement of the prong spring relative to the prong.

4. The device of claim 3, wherein each side wall of the prong springs has a proximal end that extends into the interior of the body and a leg extending from the proximal end, each leg configured to cooperate with the body to retain the prong spring on the respective prong.

* * * * *